US005979853A

United States Patent [19]

Emmons

[11] Patent Number: 5,979,853

[45] Date of Patent: Nov. 9, 1999

[54] SPEED RACK GUARD

[76] Inventor: David Winthrop Emmons, 201 Stewart Dr., Tiburon, Calif. 94920

[21] Appl. No.: 09/007,126

[22] Filed: Jan. 14, 1998

[51] Int. Cl.[6] ..... A47B 95/00

[52] U.S. Cl. ..... 248/345.1

[58] Field of Search ..... 248/345.1, 687, 248/188.1, 346.11, 118, 118.1, 118.3; 493/904

[56] References Cited

U.S. PATENT DOCUMENTS

| | | | |
|---|---|---|---|
| 652,567 | 6/1900 | Nesse | 248/118.1 |
| 2,239,679 | 4/1941 | Jones | 45/137 |
| 2,606,755 | 8/1952 | Samuels | 267/1 |
| 2,713,892 | 7/1955 | Knapp | 297/3 |
| 4,616,639 | 10/1986 | Huber | 128/99 |
| 4,710,992 | 12/1987 | Falwell et al. | 5/508 |
| 4,864,667 | 9/1989 | Adams | 4/519 |
| 5,201,078 | 4/1993 | Melton | 2/268 |
| 5,203,527 | 4/1993 | Rubey | 248/118 |
| 5,335,888 | 8/1994 | Thomsen | 248/118.5 |
| 5,437,071 | 8/1995 | Feigenbaum | 5/663 |
| 5,566,913 | 10/1996 | Prokup | 248/118 |
| 5,771,506 | 6/1998 | Joiner | 4/575.1 |
| 5,803,416 | 9/1998 | Hanson et al. | 248/118 |
| 5,816,463 | 10/1998 | Echeverri | 224/584 |

FOREIGN PATENT DOCUMENTS

| | | | |
|---|---|---|---|
| 984651 | 3/1995 | United Kingdom | 248/345.1 |

*Primary Examiner*—Derek J. Berger
*Assistant Examiner*—Michael Nornberg
*Attorney, Agent, or Firm*—McCutchen, Doyle, Brown & Enersen, LLP

[57] ABSTRACT

A speed rack guard for use in the field of restaurant and bar service is disclosed. The speed rack guard helps to reduce injuries to bartenders and other individuals working around speed racks.

15 Claims, 4 Drawing Sheets

Side Elevation 150

Plan View 156

Front Elevation 152

Rear Elevation 154

Side Elevation 402

Front Elevation 404

SPEED RACK GUARD

FIELD OF THE INVENTION

The invention relates to the field of restaurant and bar services and, more particularly, the use of speed racks for efficiently serving beverages at a bar.

BACKGROUND OF THE INVENTION

When serving beverages from behind the bar in a commercial establishment, it is generally necessary to store a wide variety of beverages to accommodate the varied tastes and demands of customers. The beverage containers generally are placed on shelves, racks and "shadow boxes" along the wall behind the bar. Drinks are generally prepared in an area usually referred to as the "well," and sometimes referred to as a "cocktail station." The well is a preparation area including an ice bin that is adjacent to or attached to the bar in front of the bartenders, at roughly waist level.

The most frequently served beverages generally are placed in a "speed rack" mounted on the well and/or other stainless steel preparation areas behind the bar at roughly knee to waist-level. This allows for efficient and convenient access to these frequently used beverages. When mounted on the ice bin, speed racks generally are mounted on the well wall facing the bartenders.

When serving customers, bartenders and other individuals need to move along the bar and frequently bump the speed racks. This commonly results in bruising and/or other injuries.

Accordingly, there is a need to prevent injuries to bartenders and other individuals while still providing the convenience and efficiency of speed racks.

SUMMARY OF THE INVENTION

According to the invention, a speed rack guard helps to prevent injuries to bartenders using speed racks and other individuals working around speed racks. The invention is useful with a wide variety of speed racks.

DETAILED DESCRIPTION OF PREFERRED EMBODIMENT(S)

Figure 1:
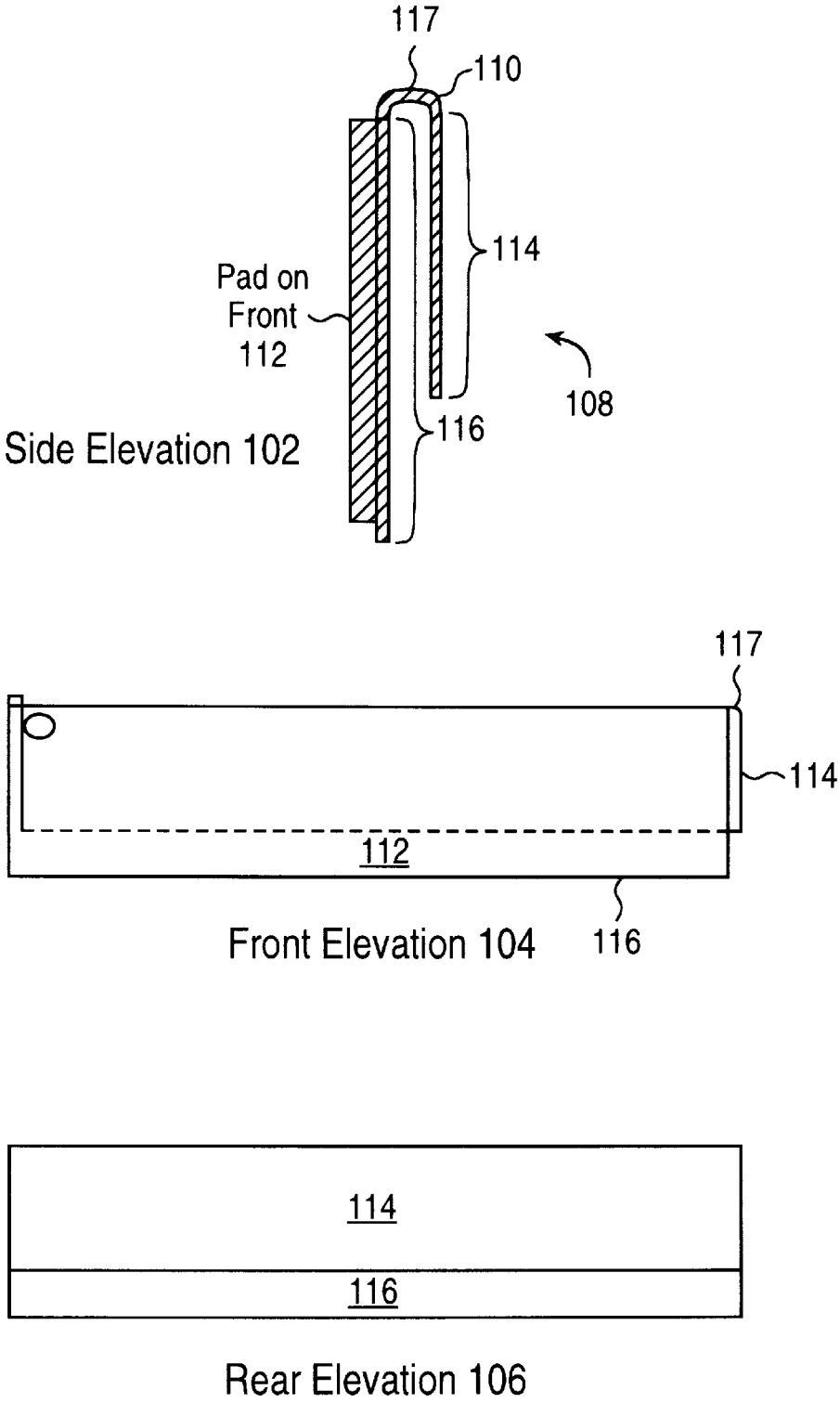
FIG. 1 shows one embodiment of a speed rack guard according to the invention.

A preferred embodiment of the invention is illustrated in FIG. 1.

According to the invention, a speed rack guard cushions the impact of an individual's body against the hard, stainless steel speed racks, sinks, table sides and tops that are used in the restaurant and bar industries.

One embodiment of a speed rack guard according to the invention is illustrated in FIG. 1. FIG. 1 shows a side elevation 102, a front elevation 104 and a rear elevation 106.

As shown in side elevation 102, speed rack guard 108 comprises a mounting 110, having two flat portions 114 and 116 that are connected along one edge 117 and maintained at a uniform distance from each other. Flat portions 114 and 116 preferably are maintained in planes that are substantially parallel to each other Attached to flat portion 116 is a pad 116 that cushions the blow or impact of an individual's body.

The distance between flat portion 114 and flat portion 116 preferably is approximately between ⅛ inch to ½ inch. The reason is that these distances allow the speed rack guard 108 to fit comfortably and easily over standard speed rack walls.

Pad 112 preferably comprises a firm gel covered by vinyl. Alternatively, in some embodiments, pad 112 comprises foam rubber. It will be clear to those skilled in the art based on the present disclosure that a wide variety of embodiments of pad 112 exist. Such embodiments are intended to be within the scope of the claims of this invention.

Front elevation 104 shows a front elevation of speed rack guard 108 and, particularly pad 112 and flat portions 116 and 114 are illustrated. Rear elevation 106 shows a rear elevation of speed rack 108 and, particularly, flat portions 114 and 116 are illustrated.

Figure 2:
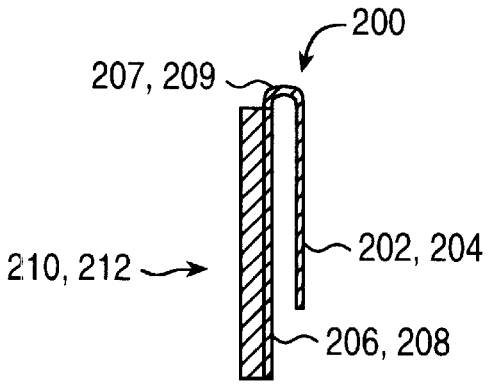
FIG. 2 shows another embodiment of a speed rack guard according to the invention.
Figure 2:
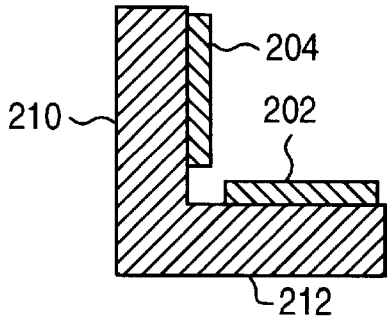
Figure 2:
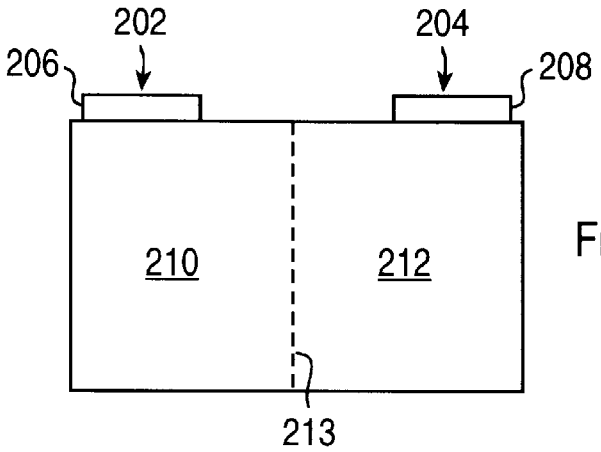
Figure 2:
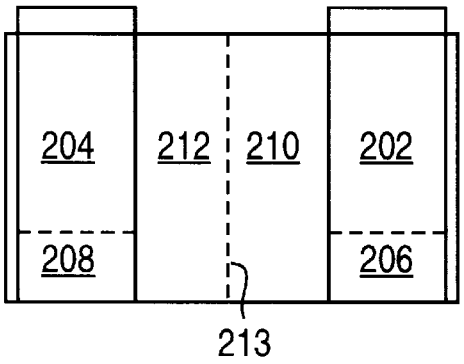

An additional embodiment of a speed rack guard according to the invention is illustrated in FIG. 2. FIG. 2 shows a side elevation 150, a front elevation of 152, a rear elevation 154 and a plan view 156 of a speed rack guard 200.

As shown in side elevation 150, speed rack guard 200 comprises four flat portions 202, 204, 206, and 208. Speed rack guard 200 also includes two pad portions 210 and 212. Flat portions 202 and 206 are connected along edge 207. Flat portions 204 and 208 are connected along edge 209. As shown in front elevation 152 and rear elevation 154, pad portion 210 is connected to flat portion 206, and pad portion 212 is connected to flat portion 208. Pad portions 210 and 212 are connected to each other along a dividing line 213, which is illustrated by a dashed line in front elevation 152 and rear elevation 154. As shown in plan view 156, speed rack guard 200 may be bent along dividing line 213 such that pad portion 210 is approximately perpendicular to pad portion 212. This allows speed rack guard 200 to fit comfortably over the corner of a speed rack.

Figure 3:
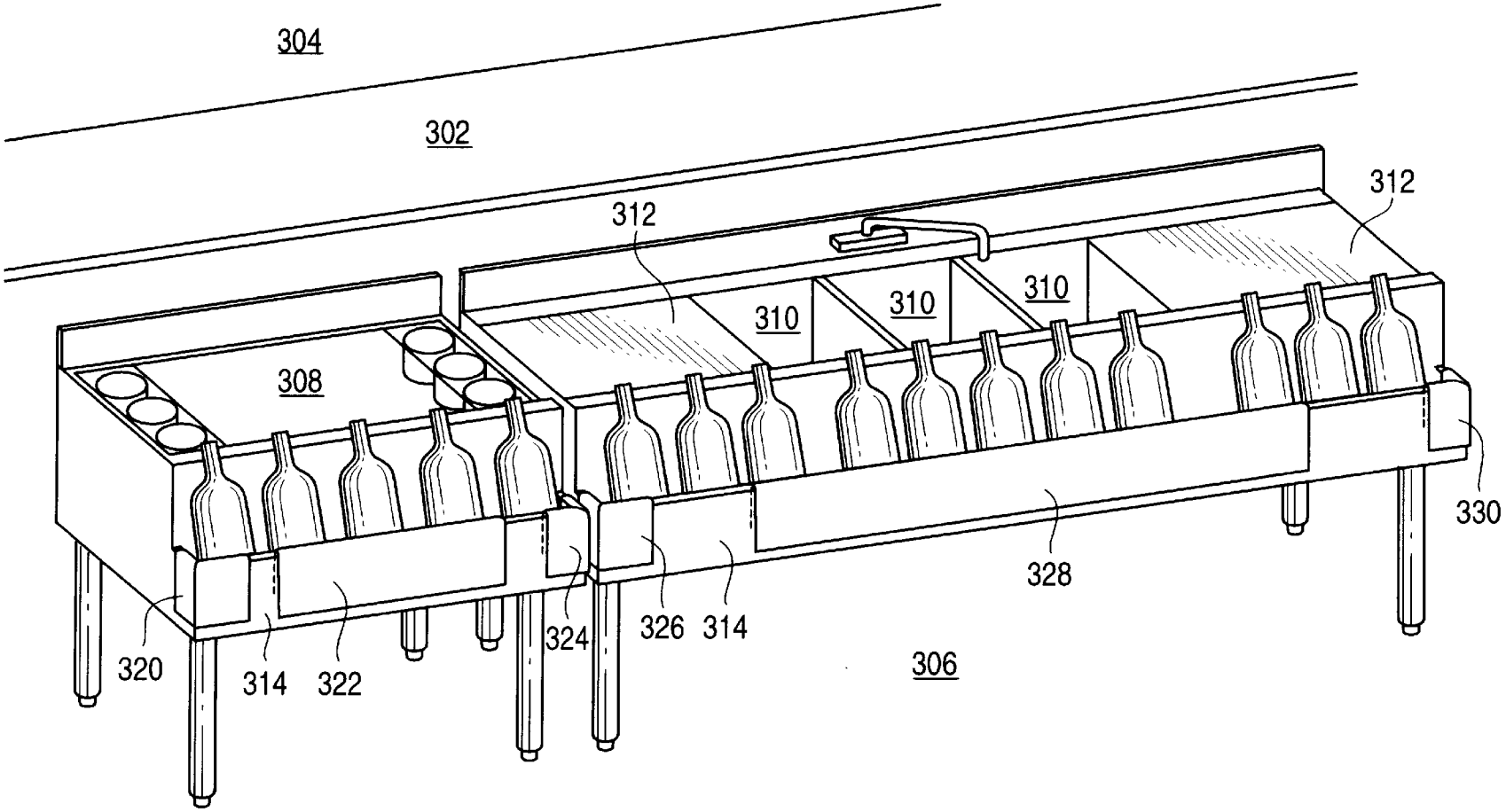
FIG. 3 shows speed rack guards according to the invention mounted on a well behind a bar.

FIG. 3 illustrates a set of speed rack guards being used behind a bar. As shown in FIG. 3, bar 302 is situated between a customer area 304 and a serving area 306. Serving area 306 includes what is commonly referred to as the "well" or "cocktail station." As such, serving area 306 includes an ice bin 308, a set of sinks 310, and preparation areas 312. Attached to these items are conventional speed racks 314. As illustrated, speed racks 314 house a set of bottles that may be easily accessed by a bartender standing in serving area 306. To prevent injuries when bartenders and other individuals inadvertently bump against speed racks 314, speed rack guards 320, 322, 324, 326, 328, and 330 are placed on speed racks 314. Speed rack guards 320, 324, 326, and 330 are embodiments substantially similar to the embodiment illustrated in FIG. 2. Speed rack guards 322 and 328 are substantially similar to the speed rack guard illustrated in FIG. 1.

In embodiments of the invention, the mounting brackets preferably are made of plastic (EX.ABS) or stainless steel. The mounting rack is preferably a minimum of 3.5 inches high and, in the case of embodiments as shown in FIG. 1, at least 17 inches long. The cover of the speed rack pad preferably is made from a vinyl or nylon, or some other material that is water and fire resistant.

Figure 4:
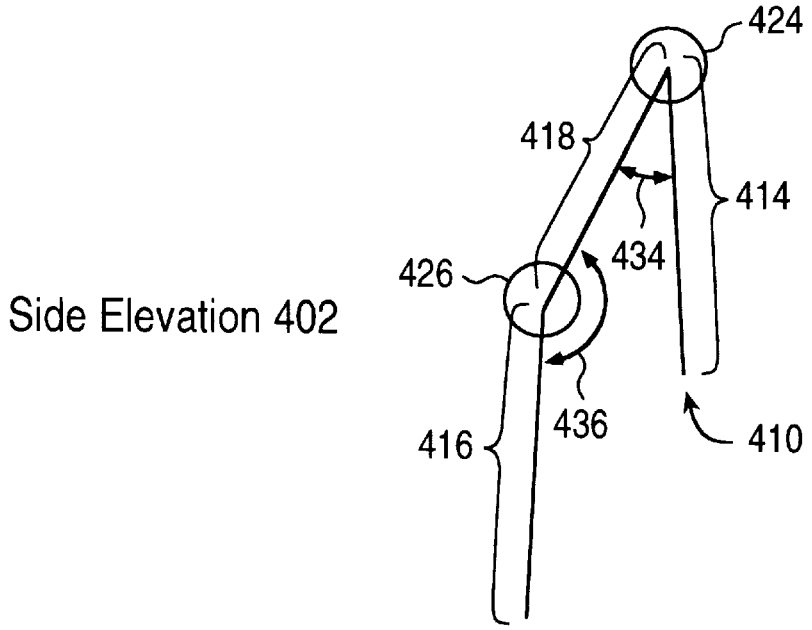
FIG. 4 shows yet another embodiment of a speed rack guard according to the invention.
Figure 4:
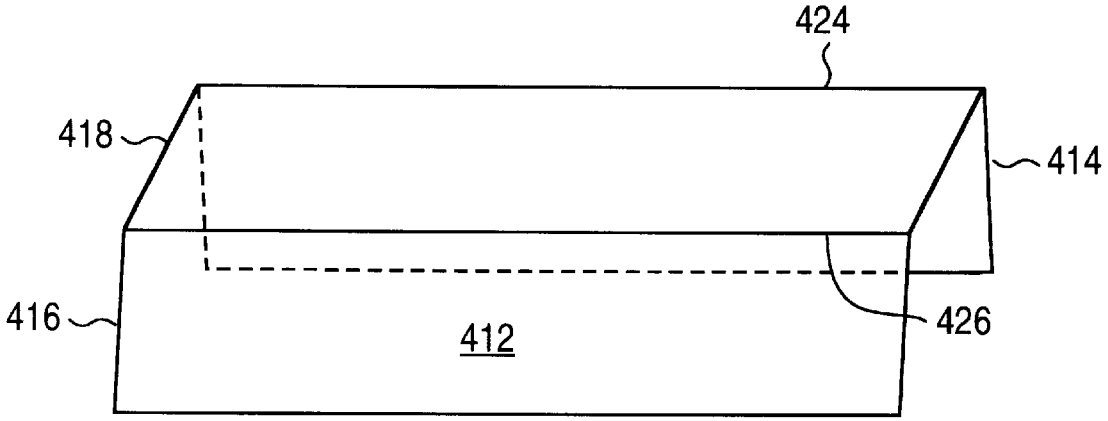

An alternative embodiment of the speed rack guard according to the invention is illustrated in FIG. 4. Shown in FIG. 4 is a side elevation 402 and a front elevation 404.

As shown in side elevation 402, speed rack guard 410 comprises a mounting having two flat portions 414 and 416 connected to each other by another flat table portion 418. Portion 414 is angularly connected to table 418 along edge 424 and portion 416 is angularly connected to table 418 along edge 426. Preferably, edge 424 and edge 426 are rounded to safeguard against injuries.

As shown in front elevation 404, attached to flat portion 416 is a pad 412 (not shown in side elevation 402) that cushions the blow or impact of an individual's body. Although the embodiment shown in FIG. 4 has a pad 412 that covers flat portion 416 entirely, those skilled in the art will understand that various pad sizes may be used.

Flat portions 414 and 416 preferably are maintained at a uniform distance from each other and in planes that are substantially parallel to each other. The interior angle 434 formed between flat portion 414 and table 418 is preferably approximately 35 degrees. The interior angle 436 formed between flat portion 416 and table 418 is preferably approximately 145 degrees. In some embodiments of the invention, Table 418 is typically between 1 inch and 3 inches in width.

Those with skill in the art will appreciate that the specific dimensions and angles of the invention may be varied to correspond to the requirements imposed by particular bar or restaurant environments.

It is to be understood that the above description is intended to be illustrative and not restrictive. Many embodiments will be apparent to those of skill in the art upon reviewing to the above disclosure. The scope of the invention should, therefore, be determined with reference to the appended claims, along with the full scope of equivalence to which such claims are entitled.

I claim:

1. A speed rack guard, comprising:

a mounting having two flat portions, the two flat portions being connected along one edge, the two flat portions being maintained at a uniform distance from each other to define a cavity therebetween; and a pad connected to an outer side of a first of the flat portions that is opposite the cavity;

wherein an inner side of the first flat portion and both sides of a second of the flat portions are uncovered so that the cavity and the second flat portion are not obstructed, and wherein the first flat portion is longer than the second flat portion, wherein the length is defined between said connected one edge and free end of said first flat portion.

2. The speed rack guard of claim 1, wherein the uniform distance is between approximately one-eighth inch and one-half inch.

3. The speed rack guard of claim 1, wherein the pad comprises a firm gel.

4. The speed rack guard of claim 1, wherein the pad has an exterior covering.

5. The speed rack guard of claim 4, wherein the exterior pad cover is vinyl.

6. The speed rack guard of claim 1, wherein the pad comprises a foam rubber.

7. A speed rack guard, comprising:

a mounting having four ABS plastic flat portions, the first two of said ABS plastic flat portions being connected along one edge to form a first bracket, the first two ABS plastic flat portions being maintained in separate but substantially parallel planes at a distance from each other to define a first cavity therebetween; and the second two of said ABS plastic flat portions being connected along one edge to form a second bracket and maintained in separate but substantially parallel planes at a distance from each other to define a second cavity therebetween, and a pad connected to an outer side of a first one of the first two ABS plastic flat portions of the first bracket that is opposite the first cavity and an outer side of a first one of the second two ABS plastic flat portions of the second bracket that is opposite the second cavity;

wherein inner sides of the first flat portions of the first and second brackets and both sides of a second of the ABS plastic flat portions of the first and second brackets are uncovered so that the first and second cavities and the second ABS plastic flat portions are not obstructed.

8. The speed rack guard of claim 7, wherein the distance between the first two flat portions and the distance between the second two flat portions is uniform.

9. A speed rack guard, comprising:

a mounting having two flat portions, the two flat portions being connected along one edge to form a bracket, the flat portions being maintained in planes substantially parallel to each other to define a cavity therebetween, the flat portions being connected to each other by a bridge portion; and a pad connected to an outer side of a first of the flat portions that is opposite the cavity;

wherein an inner side of the first flat portion and both sides of a second of the flat portions are uncovered so that the cavity and the second flat portion are not obstructed, and wherein the first flat portion is longer than the second flat portion, wherein the length is defined between said connected one edge and free end of said first flat portion.

10. A speed rack guard, comprising:

a mounting having a first portion and a second portion, the portions being maintained at a uniform distance from each other to define a cavity therebetween; and a pad connected to an outer side of the first portion that is opposite the cavity;

wherein an inner side of the first portion and both sides of the second portion are uncovered so that the cavity and the second portion are not obstructed, and wherein the first portion is longer than the second portion, herein the length is defined between said connected one edge and free end of said first portion.

11. The speed rack guard of claim 10, wherein the mounting further comprises a third portion connected between the first portion and the second portion.

12. The speed rack guard of claim 11, wherein the third portion is angularly connected between the first portion and the second portion.

13. The speed rack guard of claim 12, wherein the first, second and third portions are flat.

14. A speed rack guard, comprising:

a mounting having four stainless steel flat portions, the first two of said stainless steel flat portions being connected along one edge to form a first bracket, the first two stainless steel flat portions being maintained in separate but substantially parallel planes at a distance from each other to define a first cavity therebetween; and the second two of said stainless steel flat portions being connected along one edge to form a second bracket and maintained in separate but substantially parallel planes at a distance from each other to define a second cavity therebetween, and a pad connected to an outer side of a first one of the first two stainless steel flat portions of the first bracket that is opposite the first cavity and an outer side of a first one of the second two stainless steel flat portions of the second bracket that is opposite the second cavity;

wherein inner sides of the first flat portions of the first and second brackets and both sides of a second of the stainless steel flat portions of the first and second brackets are uncovered so that the first and second cavities and the second stainless steel flat portions are not obstructed.

15. The speed rack guard of claim 14, wherein the distance between the first two flat portions and the distance between the second two flat portions is uniform.

* * * * *